US005159755A

United States Patent [19]

Jestädt et al.

[11] Patent Number: 5,159,755

[45] Date of Patent: Nov. 3, 1992

[54] HINGED FRAMES FOR A DRY SHAVING APPARATUS

[75] Inventors: Albrecht Jestädt, Friedrichsdorf; Gerhard Schäfer, Frankfurt; Jürgen Wolf, Kriftel, all of Fed. Rep. of Germany

[73] Assignee: Braun Aktiengesellschaft, Frankfurt, Fed. Rep. of Germany

[21] Appl. No.: 776,368

[22] PCT Filed: May 21, 1990

[86] PCT No.: PCT/DE90/00523

§ 371 Date: Nov. 22, 1991

§ 102(e) Date: Nov. 22, 1991

[87] PCT Pub. No.: WO90/14932

PCT Pub. Date: Dec. 13, 1990

[30] Foreign Application Priority Data

Jun. 1, 1989 [DE] Fed. Rep. of Germany ..... 3917847

[51] Int. Cl.[5] ..... B26B 19/00; B26B 19/02

[52] U.S. Cl. ..... 30/43.92; 30/43.91

[58] Field of Search ..... 30/43.92, 43.91, 43.9, 30/43.2, 43.1, 89, 50

[56] References Cited

U.S. PATENT DOCUMENTS

| | | | |
|---|---|---|---|
| 2,318,351 | 5/1943 | Alexay | 30/43.91 |
| 4,796,359 | 1/1989 | Oprach et al. | 30/43.92 |
| 4,797,997 | 1/1989 | Packham et al. | 30/43.92 |
| 4,805,300 | 2/1989 | Miska | 30/43.92 |
| 4,930,217 | 6/1990 | Wolf et al. | 30/43.92 |

FOREIGN PATENT DOCUMENTS 0267044 5/1988 European Pat. Off. .

*Primary Examiner*—Douglas D. Watts
*Assistant Examiner*—Paul M. Heyrana, Sr.
*Attorney, Agent, or Firm*—Fish & Richardson

[57] ABSTRACT

The invention is directed to a twin-head shaver comprising a first hinged frame arranged in the shaving head frame and carrying the upper cutters, for control of a parallel relative movement of the upper cutters in the vertical direction, and a second hinged frame for the sequential control of the lower cutters operatively associated with the upper cutters.

15 Claims, 3 Drawing Sheets

HINGED FRAMES FOR A DRY SHAVING APPARATUS

This invention relates to a dry shaving apparatus comprising a drive mechanism arranged in a housing, a shaving head frame mounted on the housing, a pair of shaving heads extending in longitudinal direction parallel with each other and including each an upper cutter and a lower cutter and being movable vertically relative to and parallel with each other, a first hinged frame mounted in the shaving head frame and carrying the upper cutters for control of the relative movement of the upper cutters, and a second hinged frame carrying the lower cutters and coupled to the drive mechanism.

A dry shaving apparatus of the type initially referred to is known from EP-A No. 0 267 044. The hinged frame assembly arranged outside the housing intermediate the drive arm and the two inner cutters is comprised of a drive block pivotally mounted on the drive arm transversely to the longitudinal axis of the inner cutters and having a recess extending parallel to the longitudinal axis of the inner cutters, of a rigid mounting frame pivotally carried in this recess and having two pins arranged at its respective outer ends, and of a pair of U-shaped, parallel yoke members whose legs are provided with bores at their respective ends for pivotally receiving the pins on the rigid frame. Secured to the upper side of each U-shaped yoke member is an inner cutter carried by a double cantilever spring.

It is an object of the present invention to provide, for a shaving apparatus of the type initially referred to, a control arrangement for the two elongate lower cutters by means of which the guiding of the lower cutters is improved in both the vertical and the horizontal direction.

According to the invention, this requirement is satisfied in an apparatus of the type initially referred to in that the second hinged frame is comprised of two side members movable vertically and horizontally, a first pair of transverse link members slidably and pivotally carried in the housing, and a second pair of transverse link members pivotally carried in the housing, in which the first pair of transverse link members is coupled to the side members by means of pivot joints and the second pair of transverse link members is coupled to the side members by means of pivot and slide joints.

The configuration and mounting of the second hinged frame in the housing ensures an exact parallel arrangement and alignment of the two lower cutters on the associated side members of the second hinged frame, as well as an exact parallel movement of the two lower cutters relative to each other in vertical direction, in addition to ensuring an oscillating movement in the horizontal direction. Accordingly, the two lower cutters are linearly driven via the vertically and horizontally movable side members of the second hinged frame, while their parallel relationship is maintained. The mounting of the second hinged frame in the housing protects the hinged frame against contamination as, for example, hair dust, thus ensuring a perfect function of its movably carried components. The coupling of the lower cutters by the second hinged frame facilitates the removal of the shaving head frame equipped with upper cutters vertically movable relative to each other from the shaver housing and its replacement.

In an embodiment of the present invention, three mounting pins are arranged on each transverse link member of the first pair of links, with the center mounting pin being equidistant from the opposite outer mounting pins. Preferably, the center mounting pin forms an isosceles triangle with the opposite outer mounting pins.

For the purpose of coupling the transverse link members of the first pair of links to the side members, locking elements are provided on the outer mounting pins arranged opposite to each other.

In accordance with the invention, four mounting pins are arranged on each transverse link member of the second pair of links, with the two center mounting pins being equidistant from the opposite outer mounting pins and, lying on a common axis and pointing to opposed directions, being disposed on the sides of the wall of the transverse link members. Preferably, the two center mounting pins form an isosceles triangle with the opposite outer mounting pins.

For the hinge-type coupling of the transverse link members of the first and second pair of links to the side members of the second hinged frame, mounting bores are arranged in the ends of the side members for receiving the mounting pins of the transverse link members.

For the purpose of coupling the transverse link members of the first pair of links to the side members, locking grooves are provided in the ends of the side members in the area of the mounting bores, in order to maintain these transverse link members in permanent abutment with the side members by means of engagement of the locking elements disposed on the mounting pins into the locking grooves.

In order to transmit the driving motion to the second hinged frame, a respective cutout for coupling to the drive mechanism is provided in the longitudinal side walls of the side members, the respective cutout being centrally disposed relative to the respective ends of the side members.

In an embodiment of the invention, each of the side members has an arm extending vertically to the associated lower cutter and having its end configured as a plug-in connector.

In a preferred embodiment of the invention, two pairs of hinge bearings lying on a common axis are provided in the frame of the housing. Preferably, the two pairs of hinge bearings are configured as a snap-action coupling.

In a further embodiment of the invention, two slide and pivot bearings are arranged in the upper end of the frame in an opposed relationship and lying on a common horizontal axis.

Preferably, the slide and pivot bearings are of a U-shaped configuration. In a suitable embodiment of the invention, an opening for the drive mechanism is provided in the frame between the pairs of hinge bearings and beneath the U-shaped slide and pivot bearings.

An embodiment of the present invention will be disclosed in the following description and the accompanying drawings, in which.

Figure 1:
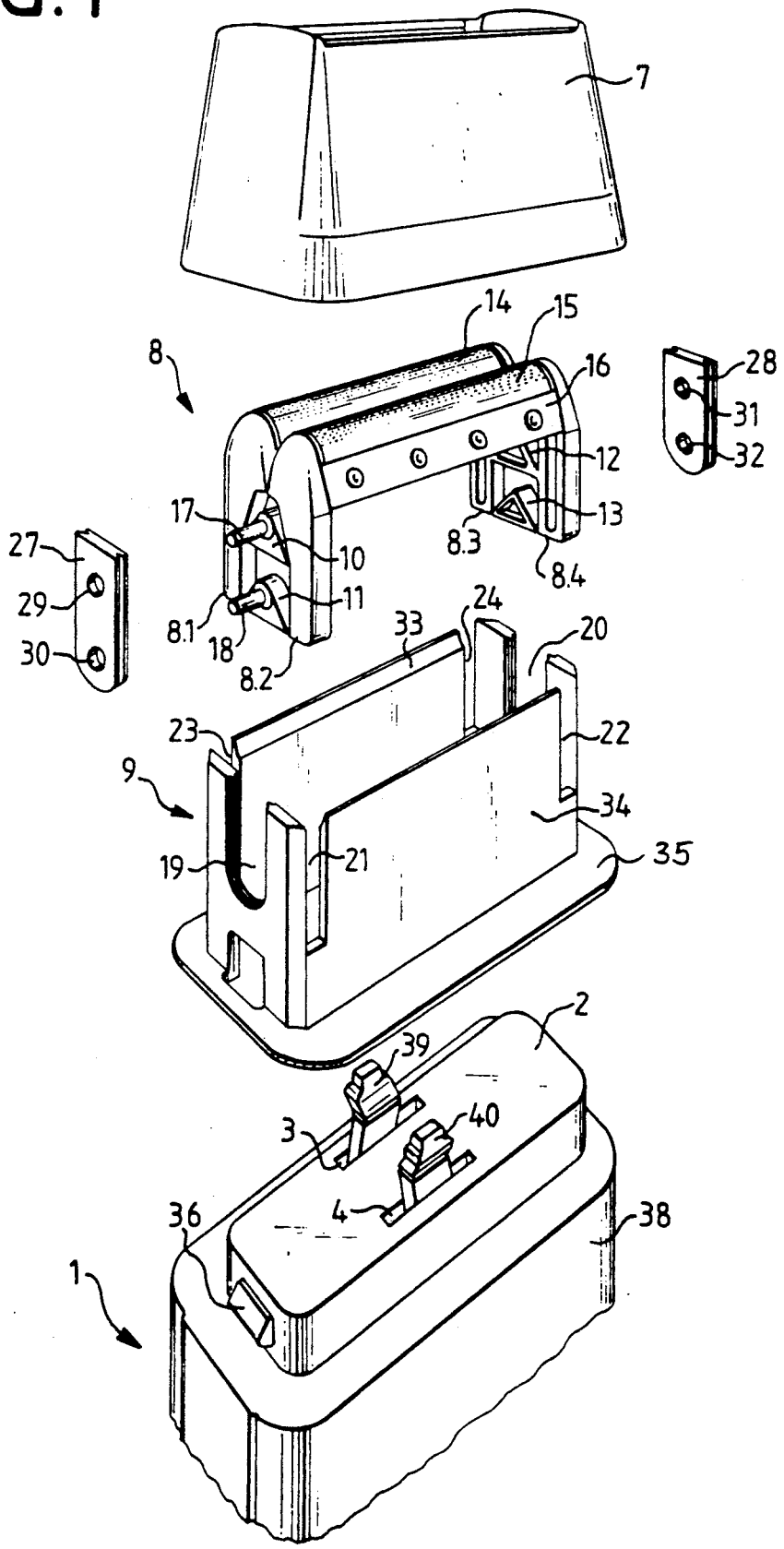
FIG. 1 is an exploded view showing a shaving head frame adapted to be seated on a housing.

In the exploded view of FIG. 1, the housing, only shown in part, of a dry shaving apparatus is identified by reference numeral 1, the arms extending out of the openings 3 and 4 of the upper housing portion 2 are assigned reference numerals 39 and 40, and the shaving head frame, the first hinged frame and the auxiliary frame carry the reference numerals 7, 8 and 9, respectively. The two opposite ends of the first hinged frame 8 comprise each a pair of end walls 8.1, 8.2 and 8.3, 8.4 which are pivotally connected with each other by a respective pair of transverse link members 10, 11 and 12, 13, for example, by means of film hinges. The end walls 8.1 and 8.3 are connected with each other by two horizontally extending side walls (not shown) to which a shaving foil 14 of arched form is attached. The end walls 8.2 and 8.4 are likewise connected with each other by two horizontally extending side walls to which a shaving foil 15 of arched form is attached and of which the side wall identified by reference numeral 16 is shown. Each transverse link member 10, 11, 12 and 13 has at its respective end a mounting pin of which the mounting pins 17, 18 provided on the transverse link members 10 and 11, respectively, are illustrated in the drawing. The mounting pins 17 and 18 lie on a common vertical axis and combine with the film hinge joints of the respective transverse link members 10 and 12 to form an isosceles triangle. The end, not shown, of the first hinged frame is identical in construction with the end shown.

In the embodiment of the shaving head frame 7 shown in FIG. 1, the auxiliary frame 9 serves the function of mounting and fastening the first hinged frame 8 in the shaving head frame. The auxiliary frame 9 is provided with six vertical recesses 19 to 24. The recesses 19 and 20 formed in the respective end walls 25 and 26 serve to mount the first hinged frame 8 by means of correspondingly formed mounting plates 27 and 28 having each two mounting bores 29, 30 and 31, 32, respectively, to receive the mounting pins provided on the transverse link members 10, 11 and 12, 13, respectively. With the hinged frame 8 and the auxiliary frame 9 in assembled condition, the end walls 8.1 to 8.4 slide within the respective recesses 21 to 24 provided in the respective longitudinal side walls 33 and 34 in vertical direction relative to and parallel with each other, constrained by the guiding of the transverse link members 10 to 13 pivotally carried by means of their mounting pins in the respective bores 29 to 32 of the respective mounting plates 27 and 28. In assembled condition, the hinged frame 8 and the auxiliary frame 9 are inserted in the shaving head frame 7 from below until abutment with the circumferential molding 35 provided on the auxiliary frame 9, and are held therein by frictional engagement means, for example, or by other fastening means. A locking element 36 provided in the wall of the housing 1 cooperates with a locking groove (not shown) provided in the shaving head frame 7 to secure the shaving head frame 7 to the housing 1.

Figure 2:
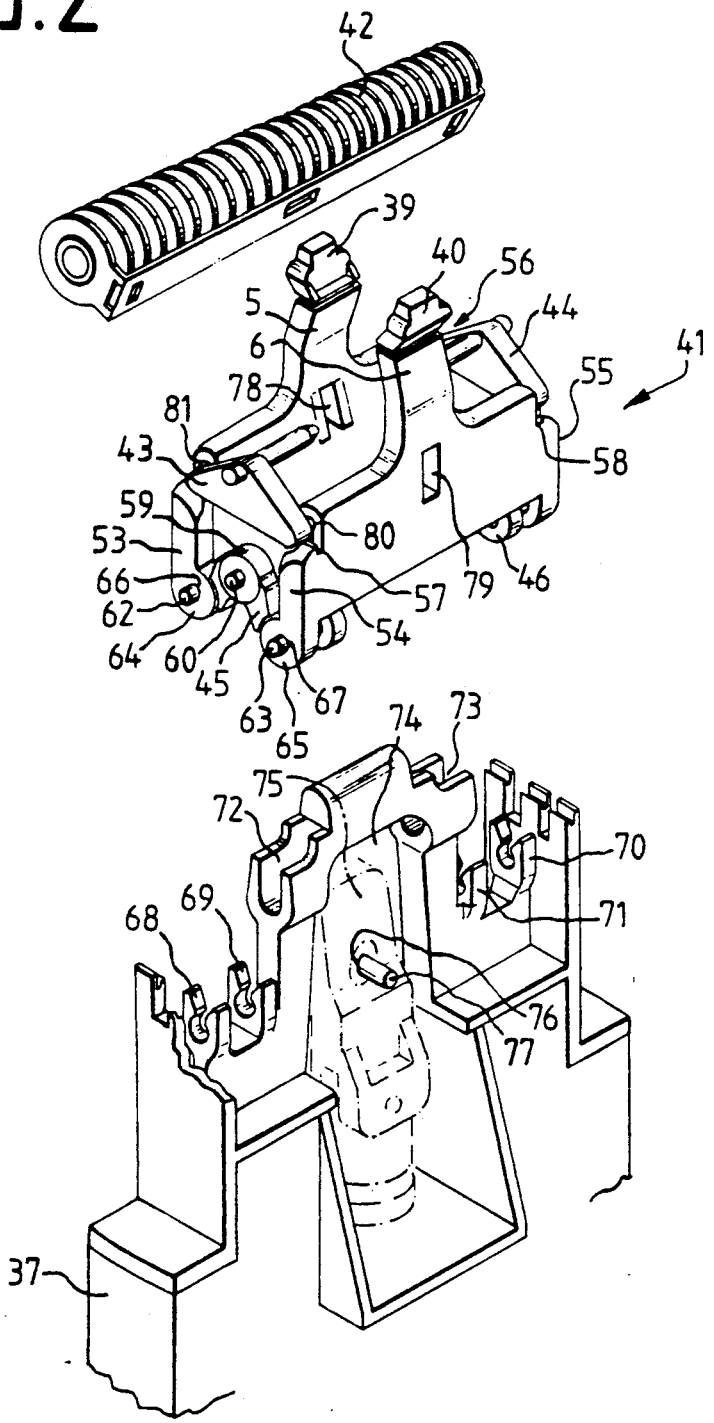
FIG. 2 is an exploded view showing the upper part of a housing with a second hinged frame and a lower cutter.

The housing 1 is comprised of a frame 37—see FIG. 2—and a shell 38 surrounding the frame 37—see FIG. 1. In a housing composed of, for example, two housing shells, the frame 37 may also be integrally formed on the inside of one of the housing shells.

As becomes apparent from FIG. 1, the upper housing portion 2 is provided with two openings 3 and 4 through which the arms 39 and 40 of the side members 5 and 6 of the second hinged frame 41 extend. The arms 39 and 40 have their ends configured as plug-in connectors to ensure ready assembly and demounting of the two lower cutters 42, of which only one is shown in FIG. 2.

The second hinged frame 41 is comprised of two T-shaped side members 5 and 6 which are coupled together with each other by means of a first pair of transverse link members 43, 44 through pivot joints and by means of a second pair of transverse link members 45, 46 through pivot and slide joints.

Figure 3:
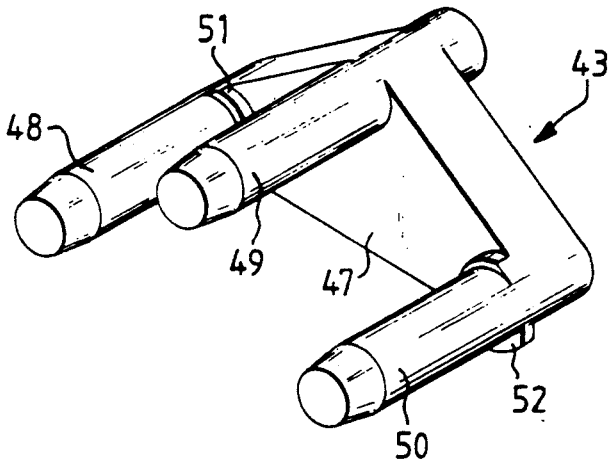
FIG. 3 is a perspective view of a transverse link member of the first pair of links.

FIG. 3 illustrates the construction of the transverse link member 43 of the first pair of links. Integrally formed on the wall 47 are three mounting pins 48, 49, 50 of which the center mounting pin 49 is equidistant from the respective opposite outer mounting pins 48 and 50. The geometrical arrangement of the mounting pins 48,49,50 corresponds to an isosceles triangle. In the area close to the wall 47, a respective locking element 51, 52 is integrally formed on the mounting pins 48 and 50. The construction of the transverse link member 44 is identical to that of the transverse link member 43.

Figure 4:
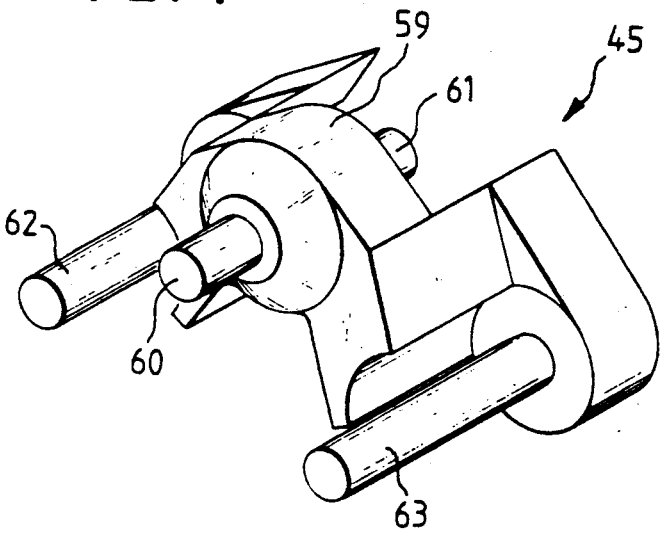
FIG. 4 is a perspective view of a transverse link member of the second pair of links.

FIG. 4 illustrates the construction of the transverse link member 45 of the second pair of links. Integrally formed on the wall 59 are four mounting pins 60, 61, 62, 63, of which the center mounting pins 60 and 61 which lie on a common longitudinal axis are equidistant from the respective opposite outer mounting pins 62 and 63. The geometrical arrangement of the mounting pins 60, 61, 62, 63 corresponds to an isosceles triangle. The mounting pins 60 and 61, pointing to opposed directions, are integrally formed on the respective side of the wall 59 in an opposed relationship and, alternatively, may also be formed by a single pin extending through the wall. The construction of the transverse link member 46 of the second pair of links is identical to that of the transverse link member 45.

The side members 5 and 6 are stepped in the upper area of their respective ends 53, 54, 55, 56. In the area where the respective horizontal stepped wall continues in the vertical stepped wall, locking grooves are formed of which the locking grooves identified by reference numerals 57 and 58 are shown in the illustration of FIG. 2.

Integrally formed in the vertical stepped walls of the ends of the side members 5 and 6 are respective mounting bores 80, 81 in which the respective mounting pins 48 and 50 of the transverse link members 43 and 44 of the first pair of links engage. The mounting bores 80 and 81 combine with the respective mounting pins 48 and 50 to form a pivot joint for the parallel side members 5 and 6 of the second hinged frame 41, with the locking elements provided on the mounting pins causing a positive-engagement coupling relationship to be established between the first pair of link members 43, 44 and the side members 5 and 6 by means of their engagement in the locking grooves.

Integrally formed on the ends of the respective end walls of the side members 5 and 6 on the side remote from the lower cutters 42 are mounting lugs which have passage bores through which the mounting pins 62 and 63 of the transverse link members 45 and 46 of the second pair of links are passed. In the perspective illustration of the second hinged frame 41 of FIG. 2, the mounting lugs formed on the ends 53 and 54 are identified by reference numerals 64 and 65, respectively, and the passage bores provided therein are identified by reference numerals 66 and 67, respectively. The center axes of the passage bores and mounting bores vertically spaced in the respective ends 53 and 54 lie on a common vertical axis for the purpose of providing a four-bar linkage. By means of the passage bores 66 and 67, the side members 5 and 6 are pivotally carried on the respective mounting pins 62 and 63 while being slidably carried in the horizontal direction.

Two pairs of hinge bearings 68, 69 and 70, 71 are provided on the frame 37 of the housing 1 to receive the mounting pins 60 and 61 provided on the transverse link members 45 and 46. The hinge bearings 68 to 71 are of a fork-shaped configuration, with a restricted area being provided between the bearing bed and the fork opening in order to rotatably hold the mounting pins 60 and 61 of the link member pairs 45 and 46 which are engaged in the bearing beds by snap action. The relative distance of the hinge bearings 68 and 69 as well as the relative distance of the hinge bearings 70 and 71 depends on the thickness of the wall 59 of the transverse link members 45 and 46 of the second pair of links, with the adjustment being made such as to ensure a vibration-free pivotal seating of the transverse link members 45 and 46 in the bearing beds of the hinge bearings 68 to 71.

Two U-shaped recesses 72, 73 lying on a common horizontal axis are integrally formed on the end of the frame 37 close to the lower cutters 42, for the purpose of providing a rotary and displaceable support for the respective mounting pins 49 of the transverse link members 43, 44 of the first pair of links.

In the area separating the pairs of hinge bearings 68, 69 and 70, 71, the frame 37 is provided with an opening 74 for extension therethrough of the drive arm 75 which causes the second hinged frame 41 to oscillate. For coupling the drive arm 75 to the second hinged frame 41, it is provided with a bore 76 in which a drive bolt 77 extending through the drive arm is fixedly arranged.

With the second hinged frame 41 mounted on the frame 37, the mounting pins 60 and 61 of the transverse link members 45 and 46 of the second pair of links are in rotatable, yet horizontally non-displaceable, engagement with the respective pairs of hinge bearings 68, 69 and 70, 71. The mounting pin 49 provided on the respective transverse link members 43, 44 of the first pair of links is in both rotatable and at the same time horizontally displaceable engagement with the respective U-shaped recesses 72 and 73. The drive bolt 77 extending through the drive arm 75 engages the elongate slots 78 and 79 provided in the side members 5 and 6, in order to transmit the driving motion directly to the side members 5 and 6 of the second hinged frame 41. The vertical extent of the elongate slots 78 and 79 allows a reciprocating motion in the same direction of the side members 5 and 6 linked to each other by means of the first and second pair of links 43, 44 and 45, 46, as well as of the lower cutters 42 disposed thereon.

The configuration of the second hinged frame 41 as described and illustrated herein and its seating in the frame 37 results in a vertical movement relative to and parallel with each other and, in addition, a horizontal linear oscillating movement of the side members 5 and 6 as well as the lower cutters 42 demountably secured thereto.

As becomes apparent from FIG. 1, the frame 37 shown in FIG. 2 and the second hinged frame 41 are surrounded by a shell 38 incorporating two openings 3 and 4. Extending through the openings 3 and 4 are the arms 39 and 40 capable of moving both in linearly oscillating fashion and vertically relative to and parallel with each other, with the openings 3 and 4 being sealed by means of suitable seals (not shown) to prevent the entry of hair 42 are attachable to the arms 39 and 40 by means of a plug-type connection, so that demounting can be accomplished readily.

We claim:

1. A dry shaving apparatus comprising a drive mechanism arranged in a housing (1), a shaving head frame (7) mounted on the housing (1), a pair of shaving heads extending in longitudinal direction parallel with each other and including each an upper cutter (14, 15) and a lower cutter (42) and being movable vertically relative to and parallel with each other, a first hinged frame (8) mounted in the shaving head frame and carrying the upper cutters (14, 15) for control of the relative movement of the upper cutters (14, 15), and a second hinged frame (41) carrying the lower cutters (42) and coupled to the drive mechanism, characterized in that the second hinged frame (41) is comprised of two side members (5, 6) movable vertically and horizontally, a first pair of transverse link members (43, 44) slidably and pivotally carried in the housing (1), and a second pair of transverse link members (45, 46) pivotally carried in the housing (1), in which the first pair of transverse link members (43, 44) is coupled to the side members (5, 6) by means of pivot joints (48, 50, 80, 81) and the second pair of transverse link members (45, 46) is coupled to the side members (5, 6) by means of pivot and slide joints (62, 63, 66, 67).

2. The dry shaving apparatus as claimed in claim 1, characterized in that three mounting pins (48, 49, 50) are arranged on each transverse link member (43, 44) of the first pair of links, with the center mounting pin (49) being equidistant from the opposite outer mounting pins (48, 50).

3. The dry shaving apparatus as claimed in claim 2, characterized in that the center mounting pin (49) forms an isosceles triangle with the opposite outer mounting pins (48, 50).

4. The dry shaving apparatus as claimed in claim 2 or claim 3, characterized in that locking elements (51, 52) are provided on the outer mounting pins (48, 50) arranged opposite to each other.

5. The dry shaving apparatus as claimed in claim 1, characterized in that four mounting pins (60, 61, 62, 63) are arranged on each transverse link member (45, 46) of the second pair of links, with the two center mounting pins (60, 61) being equidistant from the opposite outer mounting pins (62, 63), and in that the two center mounting pins (60, 61), lying on a common axis and pointing to opposed directions, are disposed on the sides of the wall (59) of the transverse link members (45, 46).

6. The dry shaving apparatus as claimed in claim 5, characterized in that the two center mounting pins (60, 61) form an isosceles triangle with the opposite outer mounting pins (62, 63).

7. The dry shaving apparatus as claimed in claim 1 wherein mounting bores (80, 81, 66, 67) are arranged in the ends (53, 56, 54, 55) of the side members (5, 6) for receiving the mounting pins (48, 50, 62, 63) of the transverse link members.

8. The dry shaving apparatus as claimed in claim 7, characterized in that locking grooves (57, 58) are provided in the ends (53, 56, 54, 55) of the side members (5, 6) in the area of the mounting bores (80, 81).

9. The dry shaving apparatus as claimed in claim 1, characterized in that a respective cutout (78, 79) for coupling to the drive mechanism is provided in the longitudinal side walls of the side members (5, 6), the respective cutout being centrally disposed relative to the respective ends (53, 56, 54, 55) of the side members (5, 6).

10. The dry shaving apparatus as claimed in claim 1, characterized in that each of the side members (5 and 6) has a respective arm (39, 40) extending vertically to the associated lower cutter (42) and having its end configured as a plug-in connector.

11. The dry shaving apparatus as claimed in claim 1, characterized in that two pairs of hinge bearings (68, 69 and 70, 71) lying on a common axis are provided in the frame (37) of the housing (1).

12. The dry shaving apparatus as claimed in claim 11, characterized in that the two pairs of hinge bearings (68, 69 and 70, 71) are configured as a snap-action coupling.

13. The dry shaving apparatus as claimed in claim 11, characterized in that two slide and pivot bearings (72, 73) are arranged in the upper end of the frame (37) in an opposed relationship and lying on a common horizontal axis.

14. The dry shaving apparatus as claimed in claim 13, characterized in that the slide and pivot bearings (72, 73) are of a U-shaped configuration.

15. The dry shaving apparatus as claimed in claim 1 wherein an opening (74) for the drive mechanism is provided in the frame (37) between the pairs of hinge bearings (68, 69 and 70, 71) and beneath the slide and pivot bearings (72, 73).

* * * * *